US006287879B1

(12) United States Patent
Gonzales et al.

(10) Patent No.: US 6,287,879 B1
(45) Date of Patent: Sep. 11, 2001

(54) ENDPOINT STABILIZATION FOR POLISHING PROCESS

(75) Inventors: David B. Gonzales; Aaron T. Bartlett, both of Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/371,827

(22) Filed: Aug. 11, 1999

(51) Int. Cl.[7] ..... G01R 31/26

(52) U.S. Cl. ..... 438/16; 438/692; 438/86; 438/16

(58) Field of Search ..... 438/692, 691, 438/693, 690, 754, 745; 216/86, 38, 89

(56) References Cited

U.S. PATENT DOCUMENTS

| | | | |
|---|---|---|---|
| 5,225,034 | | 7/1993 | Yu et al. . |
| 5,234,540 | | 8/1993 | Grant et al. . |
| 5,240,522 | | 8/1993 | Tanaka et al. . |
| 5,242,524 | | 9/1993 | Leach et al. . |
| 5,314,843 | | 5/1994 | Yu et al. . |
| 5,376,483 | | 12/1994 | Rolfson . |
| 5,407,526 | | 4/1995 | Danielson et al. . |
| 5,413,941 | | 5/1995 | Koos et al. . |
| 5,439,553 | | 8/1995 | Grant et al. . |
| 5,576,126 | | 11/1996 | Rolfson . |
| 5,637,185 | | 6/1997 | Murarka et al. . |
| 5,685,951 | | 11/1997 | Torek et al. . |
| 5,783,495 | | 7/1998 | Li et al. . |
| 6,022,807 | * | 2/2000 | Lindsey, Jr. et al. ..... 438/693 |
| 6,117,783 | * | 2/2000 | Small et al. ..... 438/692 |

OTHER PUBLICATIONS

Kojima et al., "Application of CMP Process Monitor to Cu Polishing",2000 IEEE,pp. 293–298, Aug. 2000.*

* cited by examiner

*Primary Examiner*—Charles Bowers
*Assistant Examiner*—Yennhu B. Huynh
(74) *Attorney, Agent, or Firm*—Knobbe, Martens, Olson & Bear LLP

(57) ABSTRACT

A system for performing chemical mechanical polishing wherein a dopant is added to the slurry during a chemical mechanical planarization so as to enhance end point determination. In one embodiment the CMP system includes a laser end point detection system that provides a signal indicative of the intensity of light being reflected off of the surface that is being removed by CMP. The slurry that is used in the CMP process is doped with a surfactant such that false peaks in intensity of the reflected signal is reduced so that the end point intensity peak resulting from the laser reflecting off of an underlying surface is more definite.

14 Claims, 5 Drawing Sheets

ENDPOINT STABILIZATION FOR POLISHING PROCESS

BACKGROUND OF THE INVENTION

1. Field of the Invention

The present invention relates to semiconductor processing technology and, in particular, concerns a method of planarizing the surfaces of a wafer using chemical mechanical polishing.

2. Description of the Related Art

Integrated circuits are typically comprised of a plurality of semiconductor devices formed in or on a substrate. In current applications, integrated circuits can consist of literally thousands or millions of individual semiconductor devices formed in or on the substrate. Typically, large numbers of integrated circuits are formed on a single wafer by selectively exposing regions of the wafer so as to allow for deposition or implantation of impurities into a semiconductor wafer to thereby alter the characteristics of the wafer to produce the desired different semiconductor devices. The semiconductor devices can be formed in the exposed regions of the wafer using well-known masking techniques in conjunction with well-known diffusion, implantation or deposition techniques. Over the past several decades, the scale of integration of integrated circuits has increased.

More particularly, semiconductor device fabrication techniques have been developed which allow for a higher density of semiconductor devices to be formed in the integrated circuit. As the scale of integration has increased and as the size of the individual semiconductor devices has decreased, it has become more important that integrated circuit designers and fabricators consider the structural integrity of the deposited devices and of the integrated circuit as a whole.

Repeated deposition of materials into the exposed regions of the wafer can result in the integrated circuit having a non-planar upper surface. As the upper surface of the integrated device becomes less planar, the ability to form additional semiconductor devices on the integrated circuit becomes more difficult. Moreover, the existence of protrusions in the topography of the integrated circuit affects the structural integrity of the circuit and can result in failure of the device. Consequently, integrated circuit designers and fabricators have increasingly used planarization techniques to planarize the upper surface of the integrated circuits during fabrication.

One particular planarization technique is known as chemical mechanical polishing or planarization (CMP). CMP is a technique whereby the upper surface of a wafer is globally planarized by simultaneously abrasively polishing and etching the upper surface of the wafer. Basically, the wafer is positioned adjacent a pad that is moved with respect to the wafer and the pad, and a slurry which is typically comprised of an etchant liquid. An abrasive encapsulated within a suspension fluid is introduced into the interface between the slurry and the pad. The pad is then applied to the wafer so that protrusions in the surface topography of the integrated circuits on the wafer can be removed by a combination of abrasive polishing and etching to thereby planarize and polish the upper surface of the wafer. As CMP is removing protruding layers, it is desirable to be able to stop the CMP process after the layers have been removed without damaging or removing too much of the underlying layers. Typically, various process parameters are analyzed in order to determine whether a predefined end point, indicating that a particular layer has been removed, has occurred. Hence, the process parameters are analyzed to determine whether an end point corresponding to the removal of a desired layer has occurred such that the CMP process can be stopped before excessive removal or damage of underlying layers occurs.

Presently, there are a number of different process parameters and techniques for determining end points of a CMP process. One simple technique is to analyze the current that is being drawn by the motors that are rotating the pad and the wafer. Oftentimes, the layer to be removed is more easily removed than an underlying layer such that when the pad reaches the underlying layer, the frictional engagement between the pad and the wafer increases, which causes an increase in the current that is being drawn by the motors. Another more sophisticated technique of detecting an end point of a CMP process is to shine one or more light sources, such as lasers, through a window formed in the polishing pad so that laser light reflects off of the surface of the wafer. The light sources preferably have wavelengths selected so that the intensity of the reflected light increases dramatically when the CMP process exposes the underlying layer. This type of laser-based end point technology is currently used in products available from Applied Materials, Inc. of Santa Clara, Calif. While this type of technology is useful for detecting end points, the CMP process often introduces false peaks in the intensity which can be interpreted incorrectly by the CMP processing technology as the actual desired end point for terminating the CMP process.

In particular, it is believed that the slurry used in the CMP process may polish particular regions of the wafer more quickly than other regions of the wafer. If the light source reflects off of one of these over-polished regions of the wafer, the intensity of the reflected light may increase thereby causing the CMP assembly to halt the CMP process. Subsequent evaluation may require additional polishing of the wafer which introduces inefficiencies into the manufacturing process. For example, when the CMP process is stopped, the wafer is then sent to a buffing and cleaning station before it is evaluated. If the evaluation determines that the wafer has been under-polished, i.e., the upper layer has been only partially removed, the CMP process must be restarted from an unknown starting point which tends to lead to over-polishing and possible scratching of the wafer. Moreover, as any evaluation must occur following buffing and cleaning, these steps can complicate and add expense to the manufacturing process.

To avoid these problems, the CMP assembly may be set up with thresholds that are selected to avoid under-polishing of the wafer. However, increasing the thresholds can result in over-polishing of the underlying layer. Over-polishing can result in the underlying layer being excessively thinned or scratched. Further, the underlying layer may be grown to a greater thickness to accommodate thinning of the layer occurring as a result of the over-polishing of the wafer during the CMP process. However, as the scale of integration of integrated circuits increases, there is a need to be able to form layers to more precise tolerances which is hindered by the need to form oversized layers to accommodate thinning during the CMP process.

While these problems of accurate end point detection have been described in conjunction with light-based end point detection systems, it will be appreciated that under-polishing and over-polishing problems stemming from less accurate end point detection also occur in most, if not all, end point detection systems. Hence, there is a need for a system or process whereby end point detection during the CMP process can be improved. In particular, there is a need for a process or system which enables a more accurate assessment of when a particular layer has been removed by the CMP process to thereby enable halting of the CMP process before significant CMP has occurred on an underlying layer.

SUMMARY OF THE INVENTION

The aforementioned needs are satisfied by the CMP system of the present invention which is comprised of a carriage adapted to receive a wafer, a pad that engages with the wafer wherein the pad is moving with respect to the wafer, a liquid supply system which provides a liquid to the pad wherein a dopant is added to the liquid, an end point detection system which provides a signal which is indicative of the end point of a CMP process, and a processor which controls the relative movement between the carriage and the pad and receives the end point signal such that the processor terminates the CMP process when the end point signal indicates that the CMP process is at an end point. The dopant is added to the liquid so that the end point detection system provides signals which are more accurately indicative of the actual end point of the CMP process.

In one particular embodiment, the end point detection system is comprised of a light source and detector wherein the light source shines a light onto the surface of the wafer such that when a particular surface of the wafer has been removed, the reflected light is modulated by the removal of the particular surface in a manner which is detectable by the detector. In one embodiment, the light source is a laser and the detector detects a reflected laser beam that has a higher intensity when the particular surface is removed.

In another aspect of the invention, a method of performing chemical mechanical planarization (CMP) is provided. The method comprises the steps of positioning a pad adjacent a surface of a wafer to be planarized, moving the pad with respect to the wafer, positioning a liquid on the pad so as to chemically mechanically planarize the surface of the wafer, detecting the end point of the CMP process, and doping the liquid so as to enhance the determination of the end point. In one embodiment, detecting the end point comprises shining a light source on the surface of the wafer to be planarized and observing the character of the reflected light and doping the liquid to enhance end point determination comprises introducing a surfactant into the liquid so as to reduce the occurrences of increases in the intensity of the reflected light that are unrelated to the actual end point of the process.

The present invention therefore provides a more accurate determination of the end point of a CMP process such that CMP can be more precisely halted to reduce the occurrence of under-polishing or over-polishing of the wafer. These and other objects and advantages of the present invention will become more fully apparent from the following description taken in conjunction with the accompanying drawings.

DETAILED DESCRIPTION OF THE PREFERRED EMBODIMENTS

Figure 1:
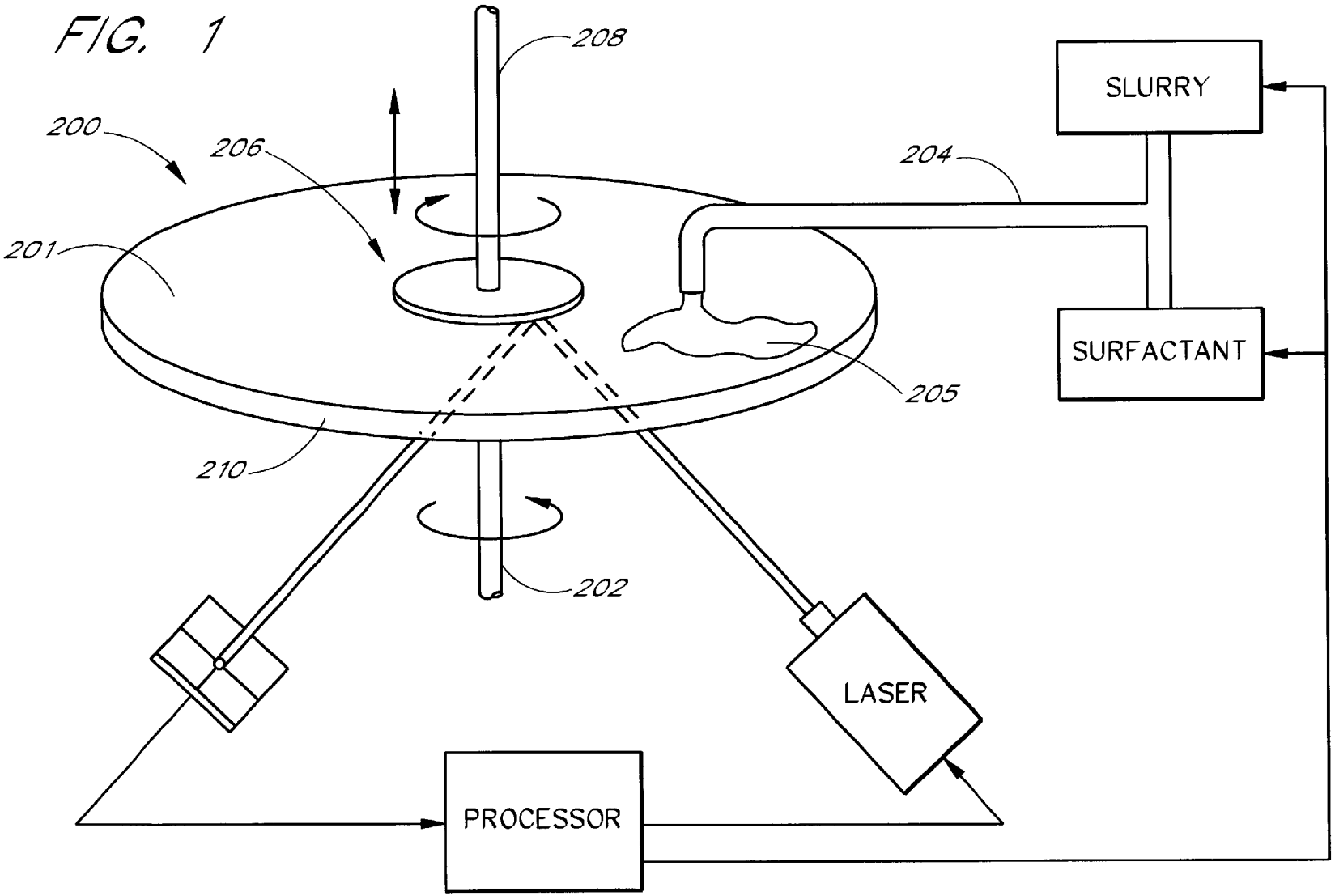
FIG. 1 is a schematic illustration of one embodiment of a chemical mechanical planarization (CMP) system that incorporates enhanced end point detection.

Reference will now be made to the drawings wherein like numerals refer to like parts throughout. FIG. 1 is a schematic illustration which illustrates a chemical mechanical planarization (CMP) system 200. The CMP system 200 incorporates a carriage 206 that is adapted to receive a wafer 210 which is to be planarized. Typically, the carriage 206 is rotatable about a shaft 208 in a first rotational direction, as indicated by the arrow 209. This CMP system also includes a pad 201 formed of a relatively soft material, such as plastic-like polyurethane, that is adapted to be rotated about a shaft 202 in a rotational direction opposite the rotational direction of the carriage 206 as indicated by the arrows 203. The CMP system 200 is also adapted so that the carriage 206 and the pad 201 can be moved relative to each other as indicated by the arrow 211 such that an exposed surface of the wafer 210 can be brought into physical contact with the pad 201 to thereby allow the pad to engage in planarization of the exposed surface of the wafer in a well-known manner.

It will be appreciated from the following discussion that, while a preferred embodiment is described in connection with a CMP system that incorporates a rotating carriage 206 and pad 201, the present invention should not be limited to only these types of CMP systems. In fact, any CMP system which incorporates translational movement between a pad 201 and a wafer 210 so as to remove portions of the wafer 210 can utilize the present invention as claimed herein.

The system also includes a slurry supply system 207 which supplies a slurry 205 to the pad 201. In one embodiment, the slurry 205 is comprised of an etchant, abrasive particles and a suspension fluid and can be one of a large number of slurries that are particularly adapted to chemical mechanical planarization of particular materials formed on the wafer 210. In another embodiment of the system 200, the pad 201 is comprised of a fixed abrasive pad having abrasives encapsulated therein and the slurry supply system 207 can be comprised of a liquid supply system that supplies a liquid to the interface between the fixed abrasive pad 201 and the wafer 210 to facilitate CMP of the wafer 210 in a well-known manner. In either embodiment, the slurry supply system 207 includes a slurry or liquid reservoir 214 which provides the slurry or liquid 205 to one or more delivery tubes 204 so that the slurry or liquid can be positioned on the pad 201. The slurry or liquid supply system 207 also includes a dopant supply reservoir 216 which, in this embodiment, is adapted to mix a dopant, such as a surfactant, in with the slurry or liquid 205 to enhance end point determination in a manner that will be described in greater detail below.

The CMP system 200 also incorporates a processor or processing system 220 that is adapted to control the CMP process performed by the system 200. In particular, the processor 220 is capable of translating the pad 201 and the carriage 206 with respect to each other and then positioning the pad 201 and the carriage 206 in proximity to each other to begin the planarization process. The processor 220 also receives end point data from an end point detection system 221 and decides, based upon the end point data, when the end of the planarization process has occurred.

In this particular embodiment, the end point detection system 221 is comprised of one or more light sources 222, such as a laser, that shine a beam 226 through the pad 201 onto the surface of the wafer 210 and a detector 224 that receives a reflective beam 228 from the surface of the wafer and provides a signal indicative thereof to the processor 220.

The light source 222 is adapted to produce a beam 226 that is selected so that the reflective beam 228 is modulated in a detectable manner upon the planarization of the wafer 210 occurring such that a particular layer of the wafer is exposed. In one embodiment, the light source 222 is comprised of a laser that produces a beam 226 of a particular wavelength that is selected so that the intensity of the reflected beam 228 increases upon the planarization of the wafer 210 occurring such that a particular layer of the wafer is exposed. The occurrence in the peak of intensity of the reflected beam 228 is indicative of the end point of the CMP process. Upon receiving such a signal from the detector 224, the processor 220 is adapted to halt the CMP process.

The system illustrated in FIG. 1 is an exemplary CMP system 200 of a type that is well known in the art. Examples of such a system include the MIRRA Chemical Mechanical Planarization System available from Applied Materials of Santa Clara, Calif. The end point detection system 221 comprised of the laser 222 and the detector 224 is similar to those types of end point detection systems that are currently available from Applied Materials of Santa Clara, Calif. Hence, the basic functionality of the CMP system 200 is similar to the functionality of CMP systems of the prior art.

However, in contrast to the CMP systems of the prior art, the CMP system 200 of the present invention is adapted to dope the liquid or slurry 205 that is being provided to the pad 201 so as to enhance end point determination. To farther facilitate an understanding of how the end point detection system 221 comprised of the laser 222 and the detector 224 functions, a description of an exemplary CMP process involving a shallow trench isolation structure will now be described in conjunction with FIGS. 2A–2C.

Figure 2A:
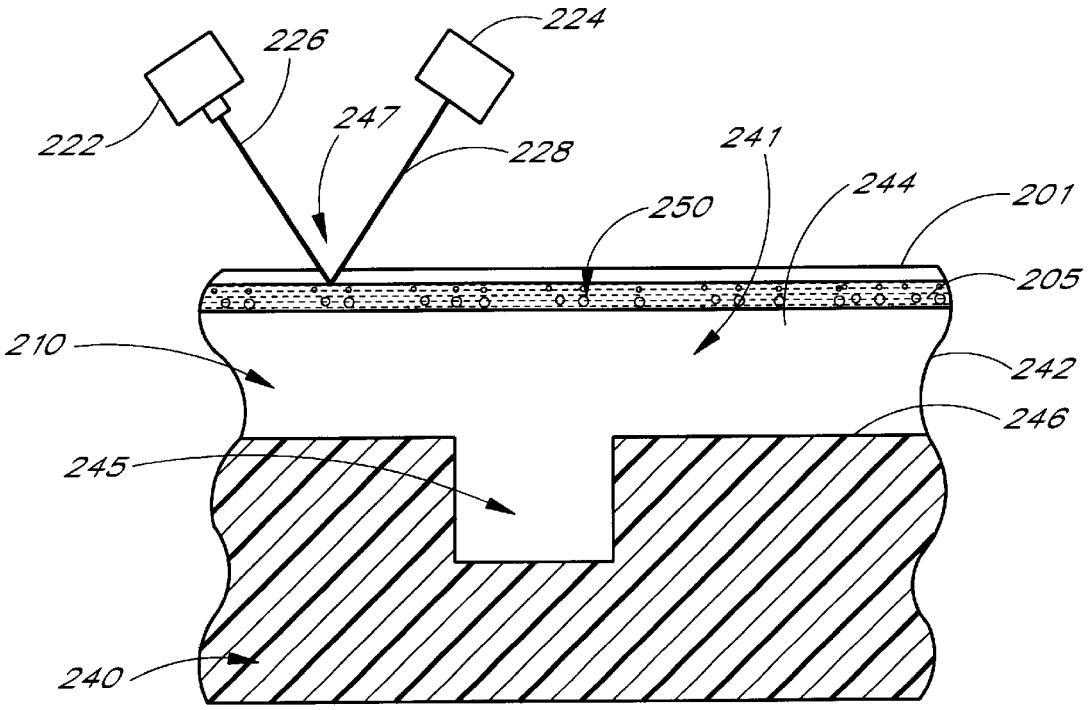
FIGS. 2A–2C are sectional views illustrating a CMP process with enhanced light-based end point detection.

In particular, FIG. 2A illustrates a substrate 240 having a cavity 245 formed therein. The substrate 240 may be comprised of any of a number of materials used in semiconductor processing, such as silicon, silicon oxide ($SiO_2$) or silicon nitride ($Si_3N_4$). In one particular embodiment used in conjunction with well-known trench isolation techniques, the substrate 240 is comprised of silicon nitride, otherwise referred to as nitride. The cavity 245 is formed in the nitride using well-known patterning and etching techniques. As is shown in FIG. 2A, an insulator material 241, such as silicon oxide ($SiO_2$), has been deposited so as to fill the cavity 245 and also so as to cover the upper surface 246 of the substrate 240. The portion of the oxide 242 positioned on top of the surface 246 is simply excess oxide that is preferably removed using chemical mechanical planarization or polishing (CMP). As shown in FIG. 2A, a pad 201 is positioned adjacent the upper surface 244 of the oxide 242 with the slurry 205 being supplied by the slurry supply system 207 so as to be interposed therebetween. The combination of the abrasive, either within the slurry 205 or encapsulated within a fixed abrasive pad 201, polishing the excess oxide 242 and the etchant within the slurry 205 etching the oxide 242 results in removal of the excess oxide 242 in a generally planar fashion.

As is also shown in FIG. 2A, the light source 222 is shining a beam 226 through an opening 247 in the pad 201 such that a reflected beam 228 is being received by the detector 224. The reflected beam 228 in FIG. 2A is reflecting off of the slurry or liquid 205 and an exposed surface 250 of the oxide material 242 positioned on the upper surface 246 of the substrate 240. As the beam 226, in one embodiment, has a wavelength selected so that the intensity of the reflected beam 228 peaks when it is reflecting off of the upper surface 246 of the substrate 240, the reflected beam 228 being received by the sensor 224 has a lower intensity when it is reflecting off of the exposed surface 250 than when the beam 228 is reflecting off of the upper surface 246 of the substrate. As will be described in greater detail below in reference to FIGS. 3A and 3B, the processor 220 is adapted to look for an increase in the intensity of the reflected beam 228 resulting from the light beam 226 reflecting off the upper surface 246 of the substrate followed by a decrease as a result of scattering of the light beams 226, 228 through the slurry or liquid 205.

Figure 2B:
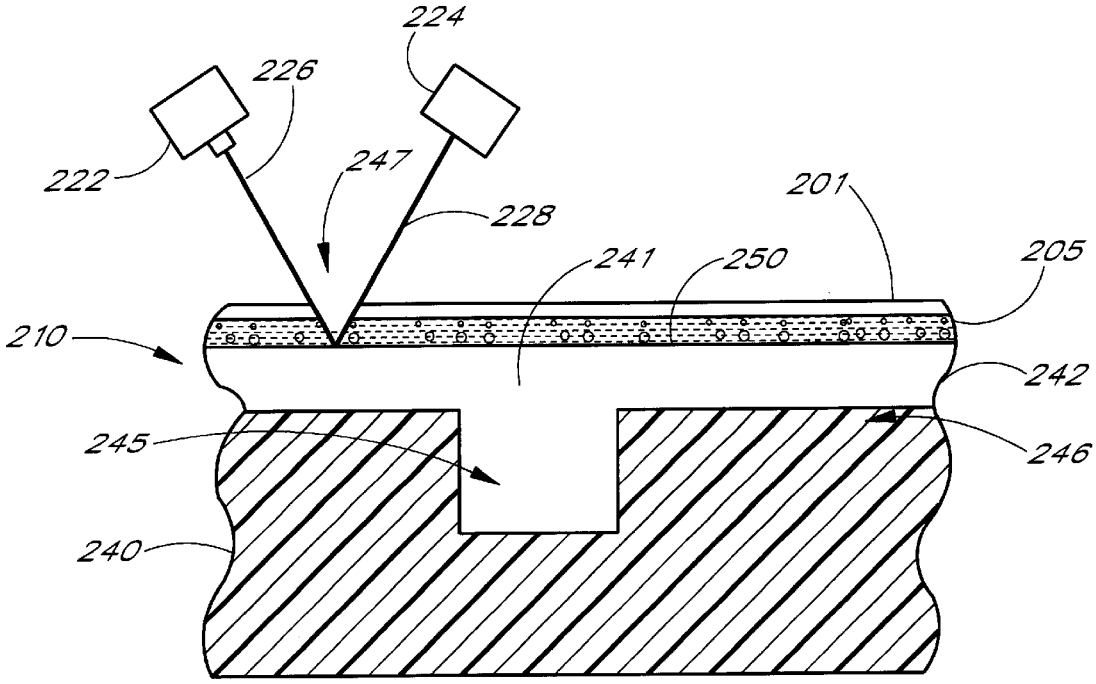

FIG. 2B illustrates the continuation of the CMP process wherein a portion of the oxide 242 has been removed as a result of chemical mechanical planarization occurring at the surface 250 in a well-known manner. The processor 220 is preferably programmed such that, as the CMP process has continued for a preselected period of time, dopant from the dopant supply tank 216 is added to the slurry 205 so as to enhance end point determination. In one embodiment, the dopant is comprised of a surfactant which has several effects on the slurry or liquid 205.

The surfactant has the effect of thinning the slurry or liquid 205 and reducing the opacity of the slurry or liquid 205 such that the light beams 226, 228 are better able to penetrate the slurry or liquid 205 to reach and be reflected from the surface 250 that is being continuously removed by the CMP process. Moreover, the addition of the surfactant also better disperses the abrasive particles in the slurry so that the CMP process is more uniformly applied at the surface 250 such that the tendency of particular regions of the surface 250 to polish faster than other regions is thereby reduced. This better dispersion of the particles makes it less likely that localized regions of the upper surface 246 of the substrate 240 will be exposed prior to general exposure of the upper surface 246 of the substrate 240 which reduces false indications of an end point.

For example, without the addition of the dopant during the CMP process, the abrasive within the slurry 205 can clump such that particular regions of the surface 250 are removed quicker than other regions of the surface 250 thereby exposing regions of the surface 246 more quickly that other regions of the surface 246. If the light beam 226 impinges upon one of these exposed regions of the surface 246, a higher intensity reflected beam 228 will be detected by the sensor 224. In prior art systems, this higher intensity reflection can be viewed as an end point which would result in the termination of the CMP process before all of the oxide 242 is removed from the upper surface 246 of the wafer 210. By adding the surfactant, the abrasive particles are more evenly distributed thereby reducing the degree of non-uniform planarization of the oxide layer 242.

Figure 2C:
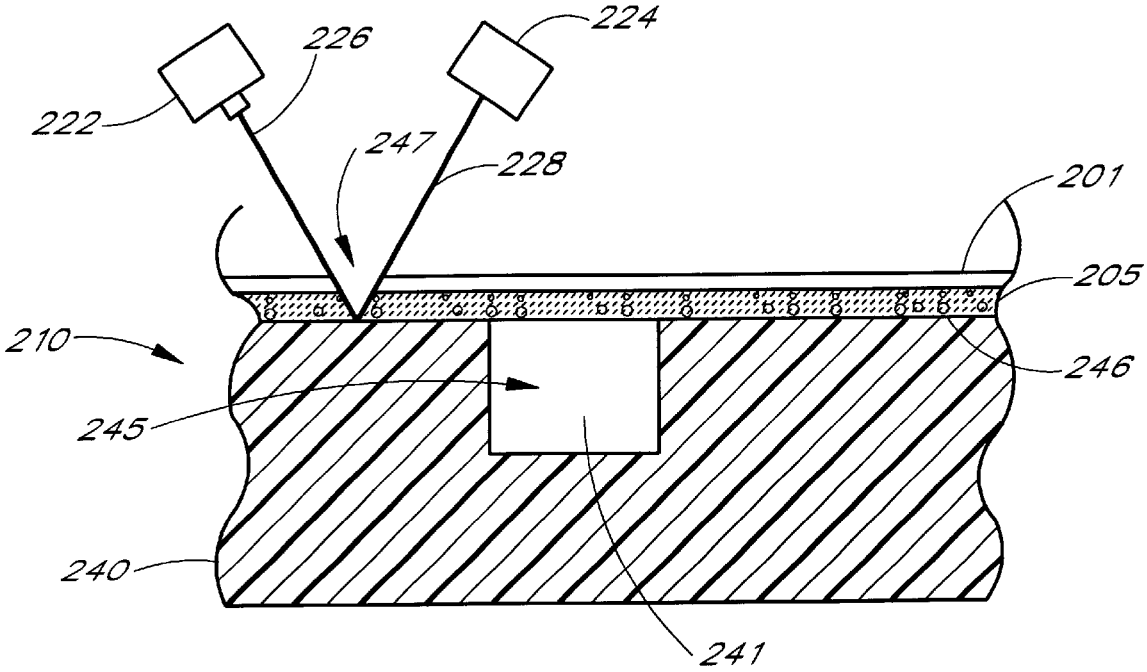

As shown in FIGS. 2B and 2C, as the surfactant is added, the CMP process is continued until the beam 228 is reflecting off of the upper surface 246 of the nitride layer 240. This results in a higher intensity beam 228 being reflected and sensed by the detector 224. By making the CMP process more uniform across the surface 250 of the oxide layer 242 through the introduction of the dopant, the end point of the CMP process can more accurately be determined which reduces the problems associated with either under-polishing or over-polishing the wafer.

Figure 3A:
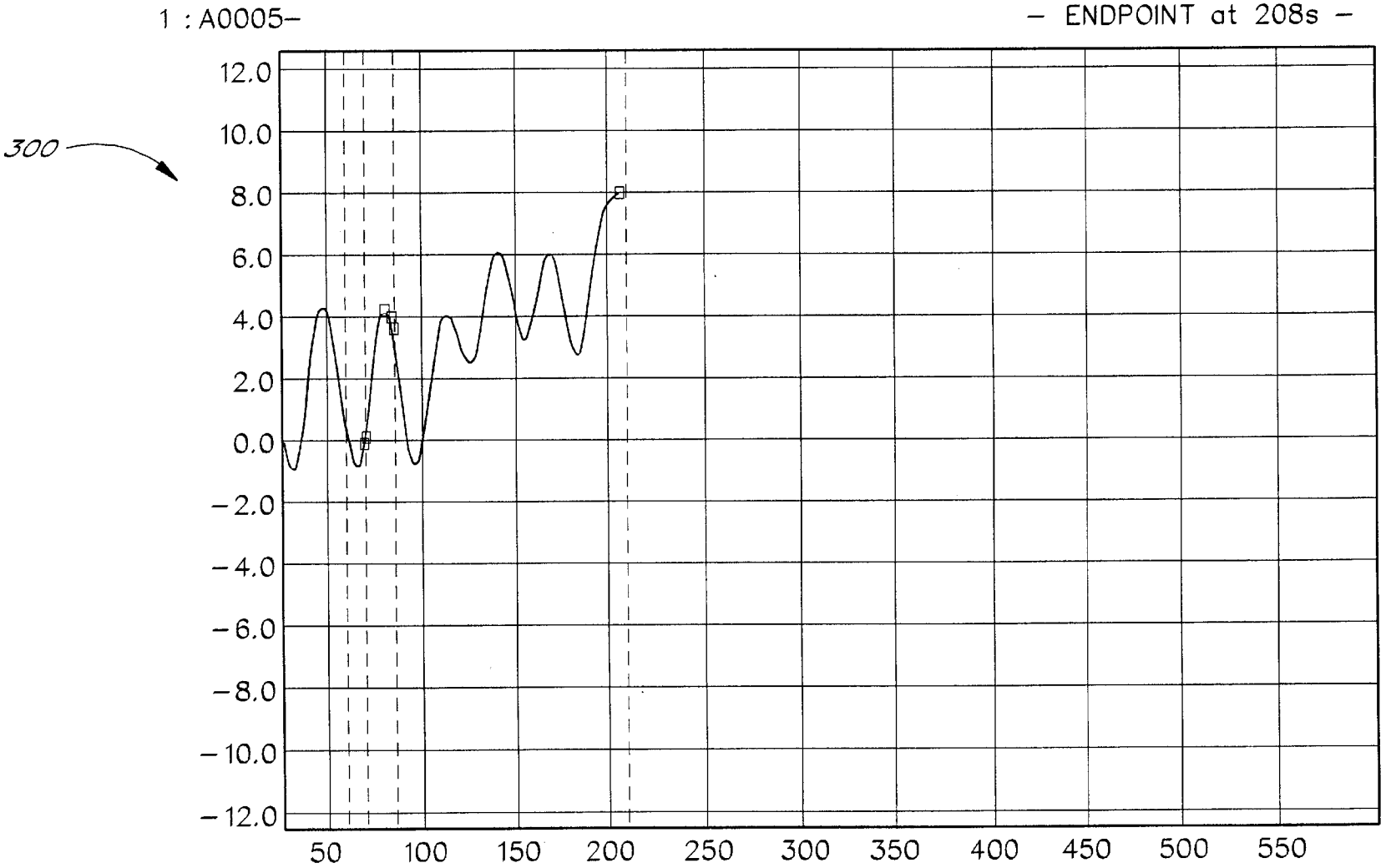
FIGS. 3A and 3B are diagrams illustrating the reflected light intensity signal that is used in end point detection in the chemical mechanical planarization system of FIG. 1.
Figure 3B:
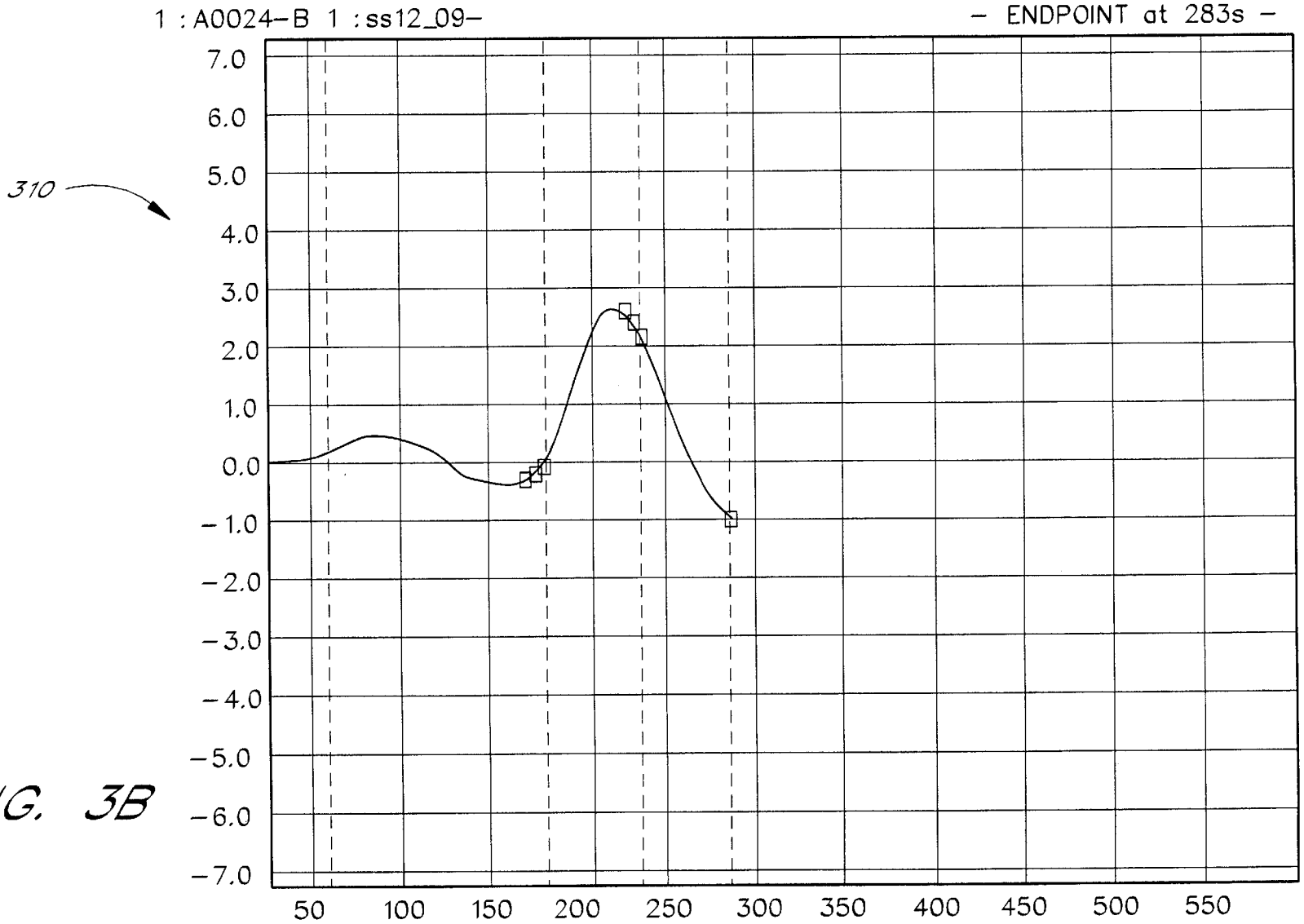

FIGS. 3A and 3B illustrate a specific embodiment of doping the slurry 205 to enhance end point detection. FIG. 3A is a trace of the removal of silicon oxide over a nitride substrate using a MIRRA-type CMP system having laser end point technology, such as the technology described above, wherein an oxide layer is being removed from a nitride substrate using a Corundum-type slurry available from Rodel, Inc., Delaware. The process represented by the trace of FIG. 3A does not include the addition of a dopant to enhance end point detection. As is demonstrated in FIG. 3A, the intensity of the reflected laser beam 228 received by the detector 224 indicates the existence of a plurality of false peaks 300 which can, in some circumstances, cause the processor 220 of the CMP system 200 to erroneously conclude that the end point of the CMP process has occurred.

Again, the Applicant believes that one explanation for this phenomenon is that this was the result of the abrasive particles within the slurry 205 being insufficiently distributed such that localized regions of the nitride surface 246 are exposed prior to general exposure of all of the nitride surface 246. As illustrated by the trace in FIG. 3A, in some circumstances, the CMP process creates a plurality of false peaks as the pad 201 polishes closer to the surface 246. The unevenness of the removal of the layer 242 of oxide is most pronounced as the CMP process approaches the surface 246 of the nitride substrate 240 and the localized regions of the surface 246 where the oxide 242 has been removed becomes more pronounced. As the localized exposed regions of the surface 246 become more pronounced, there are more intensity peaks of increasingly greater magnitude of the reflected laser beam 228 which could erroneously be interpreted as the actual end point of the CMP process when, in fact, not all of the silicon oxide material 242 has been removed from the upper surface 246 of the nitride substrate 240.

In contrast, FIG. 3B is representative of a CMP process wherein a dopant solution that is a surfactant is added to the Corundum slurry during the CMP process. The surfactant that is added in this embodiment can be comprised of any of a number of different types of surfactants including anionic, cationic or non-ionic surfactants. In one particular embodiment, the dopant solution is comprised of Brij 58 surfactant available from HPC Scientific, Portland, Oreg., which is a hydroxylated polyether that has a molecular weight of approximately 1000 g/mole that has been added to deionized water at approximately 3000 parts per million. The dopant solution is then added to a Corundum-type slurry at a ratio of approximately 8 mils of dopant solution to 100 mils of slurry. In another embodiment, the dopant solution is added to the slurry 205 at a rate of 10 mils per minute while the slurry 205 is being provided to the pad 201 and wafer 210 interface at approximately 25 to 200 mils per minute during the CMP process. In this case, the slurry dopant mixture has approximately 275 parts per million of Brij 58, however, the Applicant has noted that in some circumstances, increasing the concentration of the surfactant in the slurry 205 to greater than 200 parts per million can affect the removal rate of the oxide 242.

As discussed above, the surfactant can be added either prior to or during the CMP process. In the process corresponding to the trace of FIG. 3B, the CMP process to remove approximately 1,500 to 2,000 Angstroms of oxide from a nitride substrate required approximately 3 minutes with the dopant solution being added at the onset of the CMP process. The Applicant believes that a dopant solution can be added at different times and still obtain desirable results. For example, the Applicant believes that the dopant can be added at approximately 50% during the CMP process of the lowest typical polish time and provide end point determination enhancement. Hence, the exact dopant type can vary as can the time at which it is applied to the slurry 205.

As indicated by the trace shown in FIG. 3B, the number of false end point peaks is significantly reduced when the dopant is added to the same CMP process that was performed and represented by FIG. 3A. As shown in FIG. 3B, a single predominant intensity peak 310 occurs at the end of the CMP process and the addition of the surfactant had the effect of removing substantially all of the false peaks in the reflected intensity signal that could be falsely interpreted as an end point. Hence, the predominant intensity peak 310 occurs when the surface 246 is substantially exposed, as the intensity of the reflected beam 228 received by the detector 224 begins to increase. As a result of the beam 226 being tuned so that the reflected beam 228 has greater reflective intensity when it is being reflected off of the material forming the substrate 240, which, in this embodiment, is nitride, the end point of the CMP process can be readily determined. Preferably, the processor 220 is programmed such that, following the peak intensity, the CMP process will be stopped after the intensity has decreased to a preselected value. This ensures that substantially all of the oxide 242 is removed from the upper surface 246 of the nitride substrate 240 leaving only the oxide material 242 filling the cavity 245 in the manner shown in FIG. 2C.

In this embodiment, the processor 220 is programmed to halt the CMP process after detecting a series of intensity values which correspond to the intensity of the reflected beam 228 peaking upon the surface 246 being exposed and then decreasing as a result of the particles that are being removed from the upper surface 246 remaining in the slurry 205, causing scattering of the beams 226, 228. As is demonstrated by a comparison of FIGS. 3A to 3B, doping the slurry with the surfactant significantly reduces the occurrences of false peaks that can be misinterpreted by the processor 220 as the end point of the CMP process. Consequently, the processor 220 will more accurately determine which peak corresponds to removal of the layer 242 from substantially all of the surface 246 of the substrate 240 as opposed to only localized removal of the material 242 from localized areas of the surface 246 of the substrate 240.

It will be appreciated that, while the foregoing discussion has described the invention in connection with a light-based end point detection system, such as a laser system, the doping of the slurry can also effectuate more accurate end point determination using any of a number of end point detection schemes. The adding of the dopant, in one embodiment, ensures that the abrasive within the slurry is more evenly distributed thereby reducing the tendency of localized regions of the layer to be removed by CMP at a rate faster than the removal of the layer as a whole. It will be further appreciated that, while in one embodiment a surfactant is used as the doping characteristic and that this doping is introduced while the CMP process is occurring, any of a number of dopants that achieve more definite end point determination that are introduced either before or during the CMP process can be used without departing from the spirit of the present invention. Moreover, while the system has been described in connection with a specific application of removing an oxide layer from nitride layer, the system has a wide range of applications, including removing metals from oxides and the like.

It will be further appreciated that, while this embodiment of the invention has been described in conjunction with a rotating pad and rotating carriage CMP system, the end point enhancement system and method described herein can be adapted for use with other types of CMP systems. For example, the end point enhancement process can be readily adapted to well known web-type CMP systems, including systems having stationary platens with a rotating or orbiting carrier, without departing from the spirit of the present invention.

Although the preferred embodiment of the present invention has shown, described and pointed out the fundamental novel features of the invention as applied to this embodiment, it will be understood that various omissions, substitutions and changes in the form of the detail of the device illustrated may be made by those skilled in the art without departing from the spirit of the present invention. Consequently, the scope of the invention should not be limited to the foregoing description, but should be defined by the appended claims.

What is claimed is:

1. A method of removing a first layer of a semiconductor wafer from an underlying second layer using chemical mechanical polishing (CMP) comprising:

positioning the wafer in a carriage so that a surface of the first layer is exposed;

positioning a pad in proximity to the exposed surface of the first layer of the wafer;

inducing movement between the pad and the exposed surface of the wafer;

providing a liquid to the interface between the pad and the exposed surface of the first layer of the wafer wherein movement between the pad and the wafer results in the removal of portions of the first layer through chemical mechanical polishing;

detecting the end point of the process corresponding to removal of the first surface of the wafer and expose of substantially all of an upper surface of the underlying second layer of the wafer; and doping the liquid with a material selected so as to produce a predominant end point feature to thereby enhance detection of the end point.

2. The method of claim 1, wherein positioning the wafer in the carriage comprises positioning a wafer having a first layer of silicon oxide and a second underlying layer of silicon nitride.

3. The method of claim 2, wherein doping the liquid with a material selected so as to produce a predominant end point to thereby enhance detection of the end point comprises providing a surfactant to the slurry.

4. The method of claim 3, wherein providing a surfactant to the slurry results in the abrasive within the slurry being more evenly distributed so that localized exposure of regions of the upper surface of the second layer prior to complete removal of the first layer of material by CMP is reduced.

5. The method of claim 3, wherein providing a surfactant to the slurry comprises adding a dopant solution comprised of hydroxylated polyether surfactant having a molecular weight of approximately 1000 g/moles to the slurry.

6. The method of claim 5, wherein providing a surfactant to the slurry comprises providing the dopant solution to the slurry at a ratio of approximately 8 mils of dopant solution to 100 mils of slurry.

7. The method of claim 6, wherein providing a slurry to the interface comprises providing a slurry to the interface at a rate of approximately 25 to 200 mils per minute during the CMP removal of the first layer of the wafer.

8. The method of claim 6, wherein providing a surfactant to the slurry comprises providing the surfactant to the slurry such that the concentration of surfactant to slurry on the pad is approximately 275 parts per million of surfactant.

9. The method of claim 8, wherein providing a dopant to the slurry comprises providing the dopant solution to the slurry at a time during the CMP process which corresponds to approximately 50% of the lowest typical polishing time to remove the first layer.

10. The method of claim 8, wherein providing a dopant to the slurry comprises providing the dopant solution to the slurry throughout the entire CMP process.

11. The method of claim 1, wherein providing a liquid comprises providing a slurry having an etchant and an abrasive to the interface between the pad and the exposed surface of the first layer.

12. The method of claim 1, wherein detecting the end point of the removal of the first layer of material comprises:

shining a light beam at the interface between the pad and the exposed surface of the first layer; and evaluating the light beam reflected from the interface.

13. The method of claim 12, wherein shining the light beam at the interface comprises shining a laser beam having a wavelength selected so that the intensity of the beam reflected from the interface increases when the beam is reflecting from the upper surface of the second layer.

14. The method of claim 12, wherein doping the liquid with a material selected so as to produce a predominant end point feature to thereby enhance detection of the end point comprises doping the liquid so as to modify the beam of the light being reflected from the interface.

* * * * *